US007011019B2

(12) United States Patent
Schulte

(10) Patent No.: US 7,011,019 B2
(45) Date of Patent: Mar. 14, 2006

(54) TOGGLE PRESS

(75) Inventor: Reinhold Schulte, Eichengrund 9, Paderborn (DE) 33106

(73) Assignee: Reinhold Schulte, Paderborn (DE)

( * ) Notice: Subject to any disclaimer, the term of this patent is extended or adjusted under 35 U.S.C. 154(b) by 0 days.

(21) Appl. No.: 10/777,810

(22) Filed: Feb. 12, 2004

(65) Prior Publication Data

US 2004/0168502 A1 Sep. 2, 2004

(30) Foreign Application Priority Data

Mar. 1, 2003 (DE) ..... 103 09 030

(51) Int. Cl.
*B30B 1/14* (2006.01)

(52) U.S. Cl. ..... 100/281; 72/451; 74/106

(58) Field of Classification Search ..... 100/280, 100/281, 282, 283; 72/431, 432, 451, 40, 72/45, 53, 570, 571 R, 571 M; 83/602, 628, 83/630, 632; 425/592, 593, 451.5, 451.6; 74/106

See application file for complete search history.

(56) References Cited

U.S. PATENT DOCUMENTS

| | | | | |
|---|---|---|---|---|
| 3,763,689 A * | 10/1973 | Bridges | 72/441 |
| 3,785,282 A * | 1/1974 | Kamelander | 100/257 |
| 4,034,666 A * | 7/1977 | Bigun et al. | 100/231 |
| 5,916,345 A * | 6/1999 | Kobayashi | 83/543 |

FOREIGN PATENT DOCUMENTS

| | | |
|---|---|---|
| DE | 37 03 413 | 8/1988 |
| DE | 198 10 487 | 9/1999 |
| DE | 101 12 983 | 7/2002 |
| DE | 100 51 042 | 11/2002 |
| JP | 11058078 | 3/1999 |

* cited by examiner

*Primary Examiner*—Derris H. Banks
*Assistant Examiner*—Jimmy T. Nguyen
(74) *Attorney, Agent, or Firm*—Richard M. Goldberg

(57) ABSTRACT

A toggle press is provided with two levers (14, 16) which are pivotably connected by means of a joint (18), the first of which (14) is connected at its free end to a pressing tool (22) and the second of which (16) is rotation-resistantly mounted at its free end on a shaft (28) which can be rotated by a drive unit. The rotation-resistant connection between the second lever (16) and shaft (28) is releasable when the toggle lever reaches the extended position. The second lever (16) is disposed on a section of shaft (28) contrived as an eccentric cam (44).

5 Claims, 3 Drawing Sheets

TOGGLE PRESS

BACKGROUND OF THE INVENTION

This invention relates to a toggle press with two levers which are pivotably connected by means of a joint, the first of which is connected at its free end to a pressing tool, and the second of which is rotation-resistantly mounted at its free end on a shaft which can be rotated by a drive unit.

A toggle press comprises a toggle lever mechanism with two levers connected by means of a joint, whose free ends are connected with the associated machine frame on the one hand and with a tool or ram on the other. The ram can be moved in the direction of a workpiece by extending the toggle joint. The press can be driven by exerting pressure on the toggle joint, as well as by pivoting the lever mounted on the frame with the aid of a driven shaft. This invention is concerned with the latter type of construction.

Toggle presses can be built in a very stable fashion to permit the transmission of large forces. The design of a toggle press becomes complicated when workpieces of varying thicknesses require processing because the adjustment of the stroke and, in particular, the fine adjustment for adaptation to differing material thicknesses cannot be achieved without costly additional constructions. This is because, in the final phase of its movement through to complete extension of the two levers, a toggle press develops very high forces which can, in theory, be of an infinite order. A slightly wrong adjustment of a toggle press can therefore lead either to the destruction of the press, or to the application of insufficient machining force. Toggle presses are not, therefore, necessarily suitable for processes requiring only a relatively short working stroke applied with high force consecutive to a longish approach stroke.

There are prior art drive systems for presses whose stroke is composed of a larger approach stroke executed rapidly and with relatively low force followed by a short working stroke executed with high force. This is described with reference to a hydraulic-pneumatic press in the applicant's patent 100 51 042. The problem of adjusting the working stroke can be solved relatively easily in this case.

Hydraulic or pneumatic systems are not, however, available in every business, and in many cases, hydraulic drive systems cannot, or should not, be employed because of the constant risk of workplace contamination from leaking oil; in the food industry, for example, they are not generally permitted under existing legislation.

SUMMARY OF THE INVENTION

This invention is therefore based on the task of providing a toggle press of the above-mentioned type with a purely mechanical drive system whose stroke is composed of an approach stroke executed relatively quickly with relatively low force followed by a shorter working stroke executed with high force, and which permits an adjustment of the stroke path and the force applied at the end of the stroke path using relatively simple means.

According to the invention this task is solved in a toggle press of the above type in that the rotation-resistant connection between the second lever and the shaft is releasable, and in that the second lever is disposed on a section of the shaft contrived as an eccentric cam.

As long as the second lever is disposed rotation-resistantly on the rotatable shaft, rotating the shaft merely pivots the second lever which either prompts the extension or retraction of the toggle lever. If, on the other hand, the rotation-resistant connection between the shaft and the second lever is released, rotating the shaft will cause the second lever to move in its longitudinal direction due to the action of the eccentric cam. If the rotation-resistant connection between the second lever and the shaft is released when the toggle lever is essentially in its extended position, the eccentric cam causes a slight longitudinal movement of the tool attached to the outer end of the first lever in combination with a high pressing force.

Whilst when the second lever is pivoted, i.e. when the toggle lever is extended or retracted, the torque of the shaft acts on a stroke length equal to the distance of the axle of the shaft to the axle of the toggle joint, the lever arm is much smaller when the eccentric cam rotates in relation to the second lever.

This means that during the pressing process, the toggle joint is extended relatively quickly, and with a relatively low force, whilst a very high force develops during the intervention of the eccentric cam.

The combination according to the invention of a toggle press with an eccentric press affords the particular advantage over normal toggle presses that it permits adjustment/fine adjustment of the working stroke phase. Given that the working stroke starts when the toggle lever is already in its completely extended position, and therefore depends only on the angular position of the eccentric cam, it is possible to adjust the working stroke both regard to force and path solely via the rotation of the shaft which alters the angular position of the eccentric cam.

The occasional blocking of the second lever on the shaft may be achieved in various ways. By means of a spring, for example, which rests between a shoulder on the shaft and a point on the second lever. Hence the shaft can only rotate relative to the second lever after overcoming the elastic force.

One might also consider a magnetic block between the shaft and the second lever, or a purely mechanical block which is e.g. released when the toggle lever approaches the extended position.

Within the meaning of this description of the invention, the connection between the second lever and the shaft is thus only rotation-resistant to the extent that the rotation-resistant connection can be released under certain conditions. When the rotation-resistant connection is released, the press according to the invention is transformed from a toggle press into an eccentric press.

It is preferable to provide a stopper element on the machine frame which retains the toggle lever in the essentially extended position. When the toggle lever reaches this position the rotation-resistant connection between the shaft and the second lever is released.

This can take place in that the shaft overcomes the force of a spring which previously assured the rotation-resistant connection between the shaft and the second lever, or in that when contact occurs with the stopper element, a signal is generated which triggers an electrically controlled block. One could also provide a mechanical block which disengages when the toggle lever comes into contact with the stopper element.

Attached to the shaft there is preferably at least one radial arm which accommodates one fixation point of a compression spring, the other fixation point being provided on the second lever.

Preferred embodiments of the invention will be described below in more detail with reference to the enclosed drawings, in which

DETAILED DESCRIPTION

Figure 1:
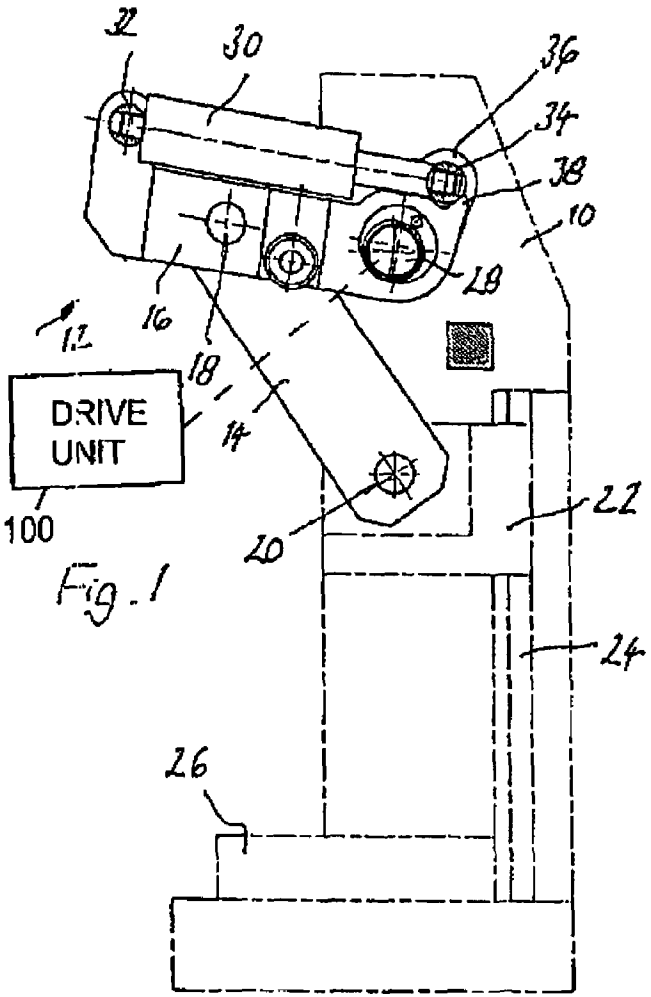
FIG. 1 is a diagrammatic view of a toggle press according to the invention, with the pressing tool in the highest position.

FIG. 1 shows a press frame 10 and a toggle lever 12. The toggle lever 12 comprises a first lever 14 and a second lever 16 which are pivotably connected to each other around axle 18.

Furthermore, the first lever 14 is connected in the vicinity of its free end by means of axle 20 to a pressing tool 22 which can be displaced up and down along press frame 10 along a guide 24. As mentioned, pressing tool 22 is shown in its highest position in FIG. 1. It can be lowered right down to a counter-tool 26 disposed at the bottom of press frame 10, as will be described in more detail below.

The second lever 16 is attached to a shaft 28 which is rotatably mounted in press frame 10 and can be rotated by means of a drive unit (100).

The second lever 16 is attached to shaft 28 in a releasably rotation-resistant manner. In the embodiment shown here, the block between shaft 28 and the second lever 16 is created by means of a pressure spring 30 which may be a compressed gas spring, a screw pressure spring or some other kind of spring element. The pressure spring 30 is mounted in a first bearing 32 on the second lever 16 and in a second bearing 34 on an arm 36 which is rotation-resistantly mounted on shaft 28 and projects radially upwards from the latter and to the right in FIG. 1. The first bearing 32 is positioned on the second lever 16 in the position furthest away from shaft 28.

The compressive force of pressure spring 30 is absorbed by a stopper element 38 located on the second lever 16 close to shaft 28. This stopper element is shown particularly clearly in FIG. 4. Hence FIG. 1 shows the completely extended position of pressure spring 30. As arm 36 is rotation-resistantly connected to shaft 28 and pressure spring 30 presses bearing 34 on arm 36 against the stopper element 38 on the second lever 16, the second lever 16 is rotation-resistantly connected to shaft 28 as long as no forces occur which overcome the spring force of pressure spring 30.

Figure 2:
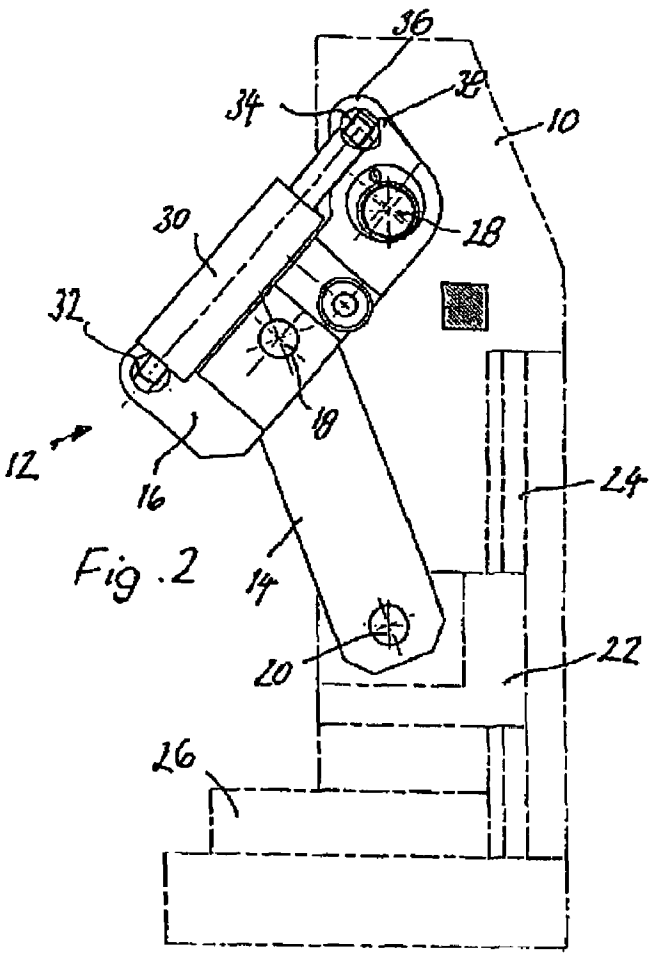
FIG. 2 is an equivalent view showing the toggle press during the downward movement of the pressing tool.
Figure 3:
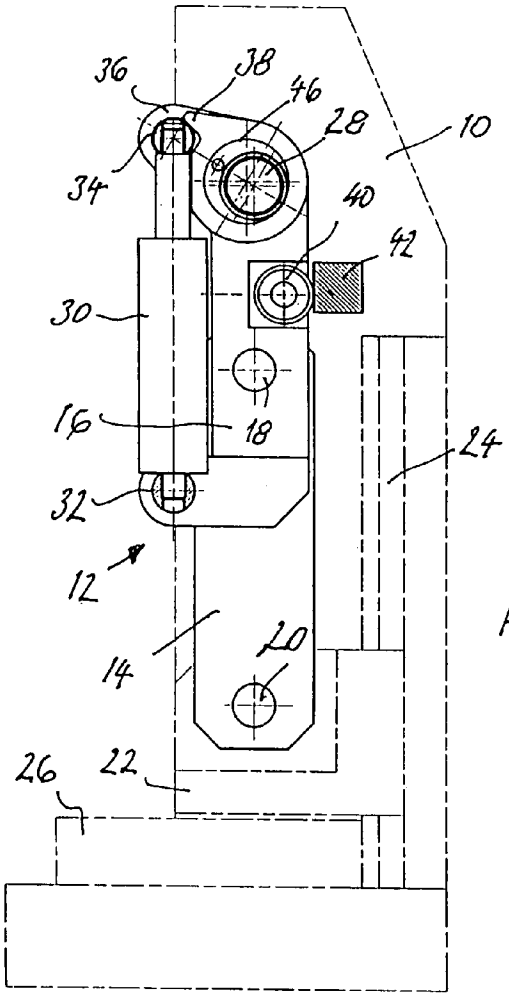
FIG. 3 shows the press in an equivalent view in which the tool is located almost at the end of the approach stroke and just before the start of the working stroke.

During the approach movement of pressing tool 22, i.e. when the pressing tool is lowered as per FIG. 1 and the following FIGS. 2 and 3, the forces to be transmitted from shaft 28 to the second lever 16 are relatively low, so that the spring force of pressure spring 30 is not overcome and hence shaft 28, the second lever 16 and pressure spring 30 together form a rigid unit.

When shaft 28 in FIG. 1 is rotated anticlockwise, toggle lever 12 begins to extend and pressing tool 22 starts to move downwards.

In the position in FIG. 2, which shows another position of the toggle lever as pressing tool 22 moves downwards, shaft 28, the second lever 16 and pressure spring 30 also form a rigidly connected unit.

The same reference numerals have been used in FIG. 2 for the same parts.

In FIG. 3, toggle lever 12 has reached its extended position, the second lever 16 is still rigidly attached to shaft 28. It can be seen that tool 22 has almost reached the under-tool with only a very small gap between the two. FIG. 3 therefore shows the position in which the actual working stroke, which has a short path, but requires a large amount of force, can begin.

Figure 4:
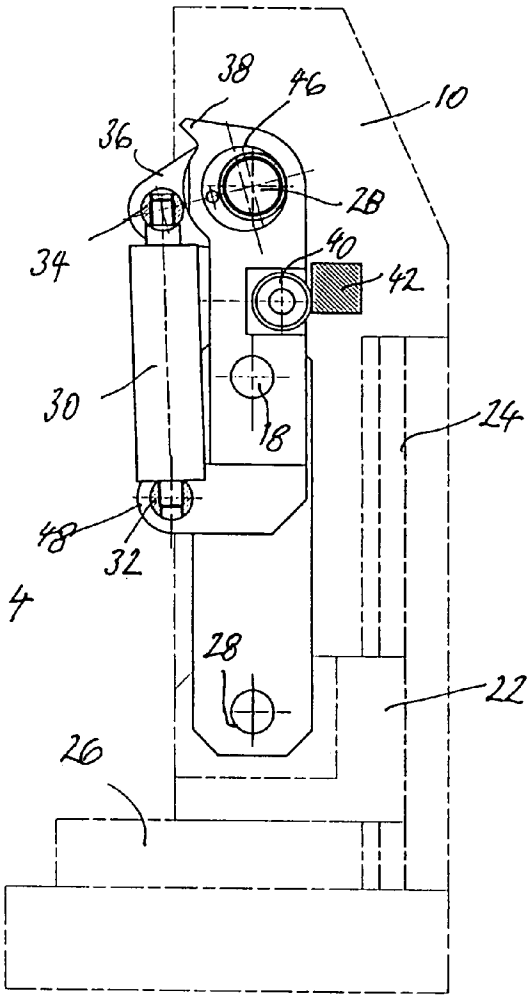
FIG. 4 shows, in another equivalent view, the press executing the working stroke.

The execution of the working stroke is explained diagrammatically in FIG. 4. The first thing to note is that in the position shown in FIG. 3, in which toggle lever 12 is completely extended, the second lever 16 with a stopper element 40 is arrested against a counter-stopper element 42 attached rigidly to press frame 10.

Hence toggle lever 12 is maintained in the extended position. The second lever 16 cannot pivot further in an anticlockwise direction.

As, however, shaft 28 continues to be driven anticlockwise, arm 36, which is rotation-resistantly attached to shaft 28, is pivoted anticlockwise, as a comparison of FIGS. 3 and 4 shows. As this happens, arm 36 exerts pressure on pressure spring 30, so that the latter is compressed, as a comparison of FIGS. 3 and 4 shows. Because the second arm 16 remains stationary during this process, shaft 28 is no longer rotation-resistantly connected to lever 16, but rotates relative to the latter. This is the sense in which the above task should be understood, that the second lever 16 is mounted rotation-resistantly, but releasably so, on shaft 28. A particularly simple solution to realising this task lies in the use of pressure spring 30, which remains rigid during the approach stroke, which requires relatively low forces, but is compressed during the subsequent working stroke, which is associated with greater force. Other means for occasionally blocking shaft 28 and the second lever 16 may also be used instead of pressure spring 30.

One might consider a magnetic coupling or a mechanical bolt, both of which could be released when the two stopper elements 40, 42 come into contact.

Further rotation of shaft 28 causes not only the compression of pressure spring 30. Disposed on shaft 28 there is an eccentric cam 44. When shaft 28 is rotated, the projecting portion of eccentric cam 44 moves downwards in FIG. 4 inside the bore 46 which accommodates the shaft with the eccentric cam inside the second lever 16. A comparison of FIGS. 3 and 4 shows this. As a result, the arrangement comprising the two aligned levers 14, 16 is moved downwards in FIG. 4. The working stroke is executed. The eccentric cam 44 allows very high forces to be exerted on the aligned toggle lever 12.

FIG. 4 shows why the stopper element 40 provided on the second lever 16, which comes into contact with the rigid counter-stopper element 42 on the press frame, is preferably contrived as a stopper roller. When shaft 28 is rotated with the eccentric cam 44 inside bore 46 of the second lever 16, the arrangement comprising the two levers 14, 16 moves slightly downwards so that stopper roller 40 can roll down counter-stopper element 42. Alternatively, sliding contact could also take place between stopper element 40 and counter stopper-element 42.

Hence the toggle press according to the invention is supplemented by an eccentric press for part of the stroke. Whilst the relatively rapid approach stroke is executed by means of the toggle press, the eccentric press takes care of the short working stroke requiring a high force.

The working stroke can be finely adjusted by changing the angular position of eccentric cam 44 in relation to shaft 28.

A suitable drive system might be provided by a motor which rotates shaft 28 to and fro through pre-defined angular positions. The press can also be designed as a manual crank press.

A further advantage of the pressure spring is that the eccentric cam is pressed back into the starting position on completion of the working stroke.

This is why bearings 32, 34 are located on the side of the toggle lever furthest from counter-stopper element 42. Bearing 32 attached to the second lever 16 is located on a shoulder 48 projecting in this direction, and the other bearing 34 is disposed on the arm 36 whose pivoting movement also takes place on the side of the second lever 16 furthest from counter-stopper element 42.

In the drawings the toggle press is shown so that pressing tool 22 is moved from top to bottom. This orientation is not, however, the only application of the toggle press according to the invention. The stroke movement of pressing tool 22 can also take place in the horizontal direction, or from bottom to top. Pressing tool 22 can be a press stamp, an embossing stamp, a punching tool, a knife or similar.

Figure 5:
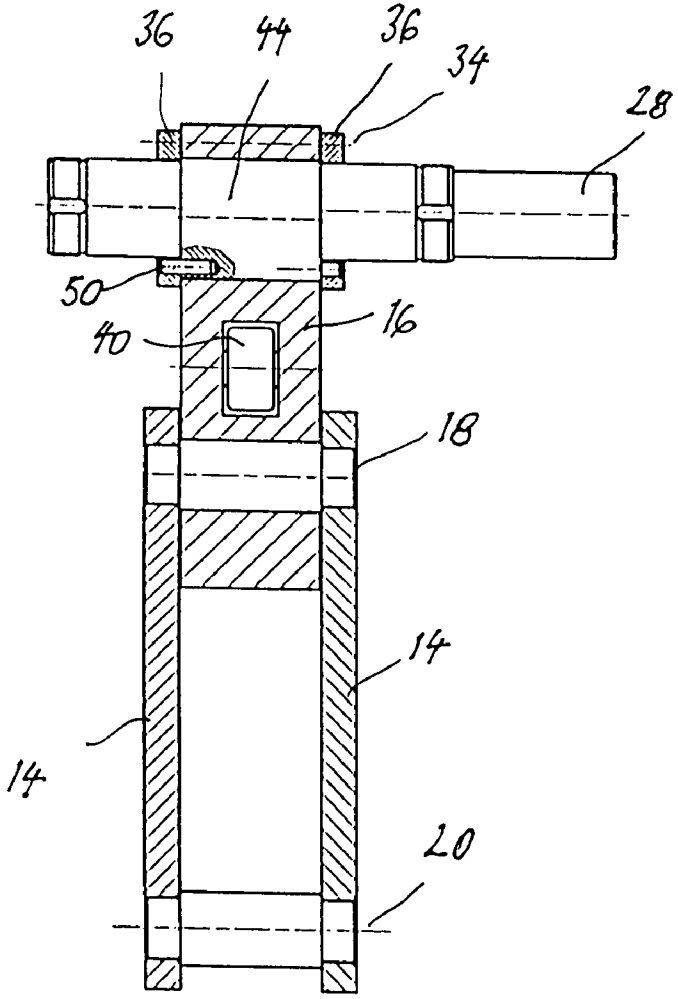
FIG. 5 is a sectional view with a sectional plane perpendicular to the plane of the drawing in FIG. 4.

FIG. 5 shows a perpendicular section perpendicular to the plane of the drawing in FIGS. 3 and 4 with a partially slightly offset sectional plane. Above all, one can see that the arm 36 is provided as a double version on both sides of eccentric cam 44. The two arm elements 36 are attached to shaft 28 in the direction of rotation by pins 50 which run parallel to the axle of shaft 28 through the arm elements and into eccentric cam 44.

FIG. 5 also shows that the first lever 14 also comprises two parallel lever parts located on either side of the second lever 16. The other parts shown in FIG. 5 are explained by the use of the same reference numerals presented in the previously described Figures of the drawings.

The invention claimed is:

1. A toggle press comprising:

first and second levers pivotally connected together by a joint, the first lever having a free end adapted to be connected to a pressing tool, and the second lever having a free end rotation-resistantly mounted on a shaft adapted to be rotated by a drive unit, the rotation-resistant connection between the second lever and the shaft being releasable, and the second lever being disposed on a section of the shaft contrived as an eccentric cam, and a pressure spring for fixing the second lever to the shaft in a releasably rotation-resistant manner, the pressure spring being disposed between a bearing of an arm mounted rotation-resistantly on the shaft and a bearing on a shoulder projecting from the second lever, such that the pressure spring presses the arm and the bearing on the shoulder apart with a pre-defined amount of compressive force.

2. The toggle press of claim 1, further comprising a stopper element on one of the levers which comes into contact with a counter-stopper element on a press frame when the first and second levers reach an extended position.

3. The toggle press of claim 2, wherein the stopper element disposed on one of the levers is contrived as a roller.

4. The toggle press of claim 2, wherein the pressure spring mounted between the bearing on the shoulder projects from the second lever opposite to the stopper element and the counter-stopper element and the bearing on the arm projects radially from the shaft, and wherein movement of the arm when the shaft is rotated lies on a side of the second lever furthest from the stopper element and the counter-stopper element.

5. The toggle press of claim 3, wherein the pressure spring mounted between the bearing on the shoulder projects from the second lever opposite to the stopper element and the counter-stopper element and the bearing on the arm projects radially from the shaft, and wherein movement of the arm when the shaft is rotated lies on a side of the second lever furthest from the stopper element and the counter-stopper element.

* * * * *